US009027775B2

(12) United States Patent
Brandt

(10) Patent No.: US 9,027,775 B2
(45) Date of Patent: May 12, 2015

(54) UNITARY LOCK RING FOR SECURING A CONTAINER LID

(75) Inventor: Richard P. Brandt, Crystal Lake, IL (US)

(73) Assignee: Container International, Inc., Palatine, IL (US)

( * ) Notice: Subject to any disclaimer, the term of this patent is extended or adjusted under 35 U.S.C. 154(b) by 274 days.

(21) Appl. No.: 13/547,025

(22) Filed: Jul. 11, 2012

(65) Prior Publication Data

US 2013/0037544 A1 Feb. 14, 2013

Related U.S. Application Data

(60) Provisional application No. 61/506,619, filed on Jul. 11, 2011.

(51) Int. Cl.
*B65D 45/34* (2006.01)

(52) U.S. Cl.
CPC ..... *B65D 45/345* (2013.01)

(58) Field of Classification Search
CPC ..... B65D 45/345
USPC ..... 220/319, 320, 321, 315, 212, 694; 292/256.6, 256.65; 215/255, 274, 352, 215/345, 341
See application file for complete search history.

(56) References Cited

U.S. PATENT DOCUMENTS

| | | | | |
|---|---|---|---|---|
| 3,795,028 | A | 3/1974 | Weiss | |
| 3,940,004 | A | 2/1976 | Faulstich | |
| 4,718,571 | A | 1/1988 | Bordner | |
| 5,129,537 | A | 7/1992 | Bordner et al. | |
| 5,713,482 | A | 2/1998 | Bordner et al. | |
| 5,785,201 | A * | 7/1998 | Bordner et al. | 220/321 |
| 5,947,320 | A | 9/1999 | Bordner et al. | |
| 2006/0220395 | A1 * | 10/2006 | Kuzelka | 292/256.69 |
| 2007/0102941 | A1 * | 5/2007 | Easterday et al. | 292/256.69 |
| 2009/0152271 | A1 * | 6/2009 | Kuzelka | 220/319 |
| 2009/0294449 | A1 | 12/2009 | Taylor | |

FOREIGN PATENT DOCUMENTS

IN 681/MUM/2006 4/2008

OTHER PUBLICATIONS

International Search Report and Written Opinion from related PCT Application No. PCT/US2012/046331 dated Oct. 18, 2012.

* cited by examiner

*Primary Examiner* — Robert J Hicks
*Assistant Examiner* — Kareen Rush
(74) *Attorney, Agent, or Firm* — Lempia Summerfield Katz LLC

(57) ABSTRACT

A lock ring for securing a lid to a container has a ring shaped body with a first end and a second end. A clamping pin is exposed near the first end and a lever is connected near the second end and has a hook thereon configured to engage the clamping pin. The lever is pivotable between a closed position and an open position. The hook is configured to selectively engage the clamping pin and draw the first and second ends to one another with the lever moved to the closed position and capable of disengaging the clamping pin the lever in the open position. The body, lever, and lock pin are integrally formed of a one-piece unitary structure and the lever is connected via a living hinge to the body.

20 Claims, 8 Drawing Sheets

UNITARY LOCK RING FOR SECURING A CONTAINER LID

RELATED APPLICATION DATA

This patent is related to and claims priority benefit of U.S. provisional application 61/506,619 filed on Jul. 11, 2011 and entitled "Unitary Lock Ring." The entire content of this prior filed application is hereby incorporated herein by reference.

BACKGROUND

1. Field of the Disclosure

The present disclosure is generally directed to drum-type storage containers and more particularly to a split ring clamp or lock ring for securing a lid to such a container, the ring having an integral one-piece molded construction.

2. Description of Related Art

Cylindrical containers or drum containers are known in the art for holding and storing chemicals, industrial materials, and the like. These types of containers are typically large drum sizes and are often constructed of either a metal material such as steel or, particularly in North America, a fiber material. Fiber drums are formed having a metal chime around the top lip or top opening as well as around the closed bottom. In other regions, particularly in Europe and the Far East, such drum containers are often formed of non-metallic and non-fibrous materials, such as plastic materials. With the rapid globalization of commerce, it has become much more common that plastic material is used for fabricating these types of drums, as well as for fabricating their removable lids. In this regard, there are ecological and other advantages associated with use of plastic drums and lids, such as the material being recoverable or recyclable.

Each container of this type has a replaceable lid retained in position by a split ring clamp or lock ring in order to securely close the top opening. International standards are developing, which may supplant separate national standards to regulate the performance of these types of drums and lids. From a national standpoint, the United States Department of Transportation (DOT), Research and Special Programs Administration, has produced standards and specifications for drum performance. Standards also have been promulgated by the United Nations organization. DOT standards typically call for drop tests to make sure the drums won't leak when subjected to some abuse or trauma during use.

The drums to be tested are filled with dry, finely powdered material to a specific net weight. The drums are then closed with the lids and then clamped by the split ring or lock ring. Depending upon the standards involved, the containers are required to withstand a drop from varying heights and at various orientations onto a hard surface such as concrete. To pass such tests or meet the standards, the drums must recover from such drops without rupture or leakage. One international testing approach involves a similar drop test, except that the drums are filled with water instead of powdered materials. Such tests also include a seal test where the drums are filled with water and upended to determine the presence of a leak.

The lids that typically close these types of drums are formed from stamped metal or molded plastic. The lids are then secured onto the drums by the split ring clamps or lock rings. Such clamps or lock rings have a channel to capture a rim of the lid-to-drum interface. An over-center lever is generally used to draw the ends of the split ring clamp structure together. In the past, these lock rings or clamps were made of steel and were durable and sturdy, but heavy and expensive. However, for many packaging, transportation, and incinerator container applications, industrial users of such drum containers have sought to avoid metal components such as lids and lock rings or split ring clamping devices. The known metal devices do not burn, are prone to corrode, and can sometimes insert minute metallic contaminants with the material packaged within the containers.

Plastic lids have been successfully developed, such as is described in U.S. Pat. No. 4,718,571. For some period of time, the development of corresponding plastic clamping rings, which could remain competitive in terms of cost and clamping performance, eluded those in the art until a successful all-plastic polymeric two-piece split ring clamp was devised. Such a plastic clamp ring found success in conjunction with fiber type drums, and is described in U.S. Pat. No. 5,129,537.

The two-piece polymeric split ring clamp described in the above noted '537 patent has remained popular for use with fiber-based drums. However, its experimental application for clamping plastic lids on plastic drums demonstrated a need for a more secure union between drum and lid. Plastic drums and lids typically are less rigid or study than metal drums, fiber drums with steel chimes, and metal lids. Further, the plastic split ring clamp, while advantageously being formed of only two major parts, had exhibited a profile at its over-center pivot level that protruded outwardly a substantial amount from the side of the drum and lid to which it is secured. Such a large protruding ring portion can significantly hinder drum handling. Also, when containers employing plastic lids and plastic drums are subjected to drop tests, excessive stress was imposed, for example, upon the lever pivot shaft or pin that was integrally formed upon the pivot arm of the clamping system.

U.S. Pat. No. 5,713,482 disclosed a split ring clamp or lock ring that provided a degree of improved performance in these areas. However, the ring disclosed in the '482 patent still was made from two separate parts including the split ring and the over-center lever, as well as the parts to attach the lever to the ring. The two parts must be separately fabricated from two different molds and then assembled afterwards in a separate process. The pivot joint of the over-center lever is also still subjected to a large amount of stress when securing the lock ring or clamp onto a drum and lid assembly and after being secured.

SUMMARY

A lock ring for securing a lid to a container is disclosed and described herein in accordance with the teachings of the present invention. The lock ring in one example has a ring shaped body with a first free end and a second free end. A clamping pin is exposed near the first free end and a lever is connected near the second free end and has a hook thereon configured to engage the clamping pin. The lever is pivotable between a closed position and an open position. The hook is configured to selectively engage the clamping pin and draw the first and second free ends closely adjacent one another with the lever moved to the closed position and capable of disengaging the clamping pin with the lever in the open position. The body, lever, and lock pin are integrally formed of a one-piece unitary structure and the lever is connected via a living hinge to the body.

In one example, the body, lever, and lock pin can be formed of the same material. The material can be any suitable plastic material, resin material, thermoplastic material, Nylon material, moldable composite material, or the like. The invention is not limited to any specific material. The material should however be flexible, resilient, relatively strong under tension, and capable of being molded into relatively complex shapes.

In one example, the body can have a generally C-shape in cross-section. The body can have an upper leg, a lower leg, a vertical leg connecting the upper and lower legs, and a radially inward facing channel defined within the upper, lower, and vertical legs configured to engage and receive portions of a container and lid assembly therein.

In one example, an upper leg of the body can have a downturned portion at an innermost edge thereof to snap over and onto a portion of a lid on a container.

In one example, a lower leg of the body can have a bead formed on an innermost edge thereof to nest under a rim of a container. The bead can have a rounded face thereon facing radially inward.

In one example, the second free end of the body can be sized to fit or nest within the first free end of the body when the lock ring is in a closed configuration and the lever is in the closed position.

In one example, the living hinge can be positioned adjacent a notch formed in the vertical leg of the body near the second free end.

In one example, the lock ring can have a lock tab protruding from a portion of the body and a tab hole formed through the tab. A lock opening can be formed in the lever and a lock hole can be formed through the lever. The lock tab can be positioned within the lock opening in the lever and the lock hole can align with the tab hole when the lever is in the closed position. A part of a lock can be received through the tab hole and lock hole to lock the lever in the closed position.

In one example, the lock ring can be formed of a molded plastic material. Again, the material can vary.

In one example, the lever can nest over the second free end of the body in the closed position and the second free end of the body can nest within the first free end of the body with the lock ring in a closed configuration.

In one example, the lock ring can include one or more bosses protruding from a part of the lock ring near the living hinge. One or more guide tracks can be formed in another part of the lock ring near the living hinge. Each of the one or more bosses can slide along a corresponding track of the one or more guide tracks when the lever is moved between the open and closed positions.

In one example, the lock ring can include two bosses, one each on a side of the body near the second free end. The lock ring can also include two guide tracks, one each on opposed sides of the lever. Each of the bosses can slide along a corresponding one of the tracks when the lever is moved between the open and closed positions.

In one example, the lock ring can include one or more bosses protruding from a part of the lock ring near the living hinge. One or more curved guide tracks can be formed in another part of the lock ring near the living hinge. Each of the one or more bosses can slide along a corresponding track of the one or more curved guide tracks when the lever is moved between the open and closed positions.

In one example, the lock ring can include one or more bosses protruding from a part of the lock ring near the living hinge. One or more guide tracks can be formed in another part of the lock ring near the living hinge. Each of the one or more bosses can slide along a corresponding track of the one or more guide tracks when the lever is moved between the open and closed positions. The one or more bosses and guide tracks can be covered and hidden by a portion of the lock ring with the lever in the closed position and the lock ring in a closed configuration.

In one example, the lock ring can include one or more bosses protruding from a part of the lock ring near the living hinge. One or more guide tracks can be formed in another part of the lock ring near the living hinge. Each of the one or more bosses can slide along a corresponding track of the one or more guide tracks when the lever is moved between the open and closed positions. Portions of the first free end of the body can move onto and cover and hide the one or more bosses and guide tracks with the lever in the closed position.

In one example, the lock ring can have one or more bosses and one or more guide slots that engage one another to destress or unload the living hinge when the lever is moved between the open and closed positions. In one example, the bosses can seat in a closed end of the respective guide tracks in the closed position.

In one example, the lock ring can have one or more bosses and one or more guide slots that engage one another to destress or unload the living hinge when the lever is moved between the open and closed positions. Portions of the first free end of the body can move onto and cover the one or more bosses and guide tracks with the lever in the closed position.

In one example according to the teachings of the present invention, a lock ring for securing a lid to a container can be reconfigurable between a locked and an unlocked configuration. The lock ring has a ring shaped body with a first end, a second end, and a split therebetween. A clamping pin is exposed near the first end and a lever is connected near the second end and has a hook thereon configured to engage the clamping pin. The lever is pivotable between a closed position and an open position. The hook is configured to selectively engage the clamping pin and draw the first and second ends closely adjacent one another with the lever moved to the closed position and capable of disengaging the clamping pin the lever in the open position. A guide track on one of the body and the lever. A boss is on the other of the body and the lever and is configured to seat in and move along the guide track as the lever is moved toward the closed position. The body, lever, clamping pin, guide track and boss are integrally formed as a one-piece unitary structure and the lever is connected via a living hinge to the body. The boss and guide track are arranged to redefine the lever pivot from the living hinge with the boss engaged with the guide track.

In one example, the lock ring can include a lock tab protruding from a portion of the body and have a tab hole formed through the tab. A lock opening can be formed in the lever and a lock hole can be formed through the lever. The lock tab can be positioned in the lock opening in the lever and the lock hole can align with the tab hole with the lever in the closed position.

In one example, portions of the first end of the body can move onto and cover and hide the one or more bosses and guide tracks with the lever in the closed position.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The unitary lock rings disclosed and described herein solve or improve upon one or more of the above-noted and/or other problems and disadvantages with prior known lock rings, split ring clamps, and like clamping devices of this type. In one example, the disclosed unitary lock ring is molded as a one-piece, integral unit and is entirely formed of plastic. The disclosed lock rings require no sub-assembly, no separate, discrete molds, and no after-assembly. The construction of the disclosed lock rings also reduces or eliminates stress on the lever pivot joint once closed or clamped. The disclosed lock rings alter the stress points placed upon portions of the ring when it is closed or clamped during use. The disclosed lock rings also have a lower profile, which improves handling of drums having lids secured thereby. These and other objects, features, and advantages of the disclosed unitary lock ring may become apparent upon reading this disclosure.

Figure 1:
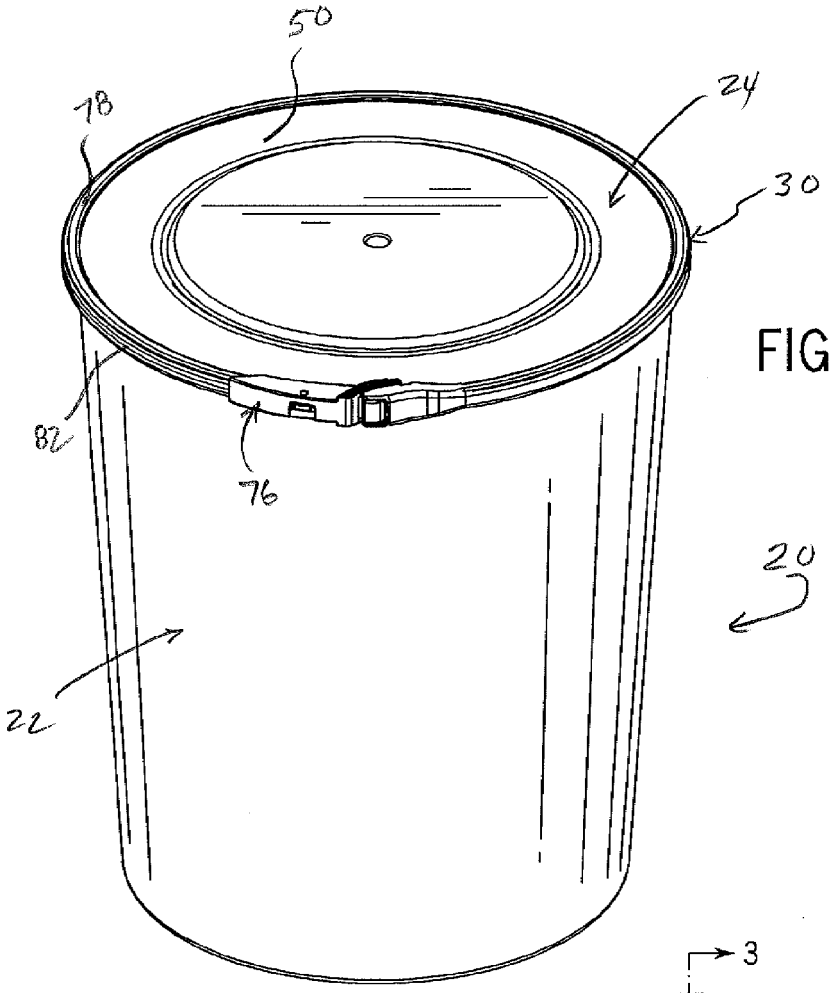
FIG. 1 shows a perspective view of one example of a container assembly including a drum, a lid, and a one-piece plastic or unitary lock ring constructed in accordance with the teachings of the present invention.
Figure 2:
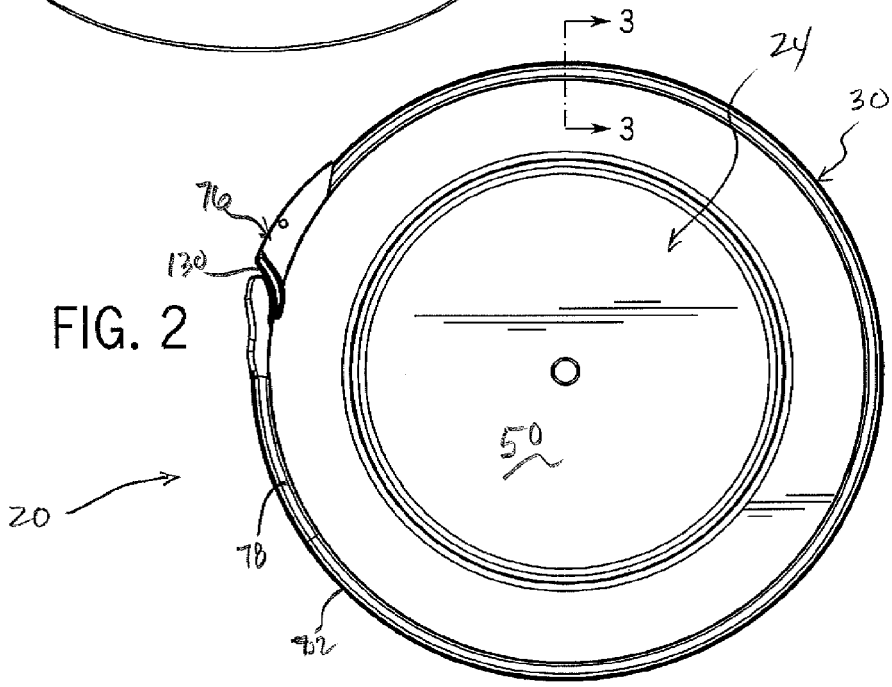
FIG. 2 shows a top view of the container assembly shown in FIG. 1
Figure 3:
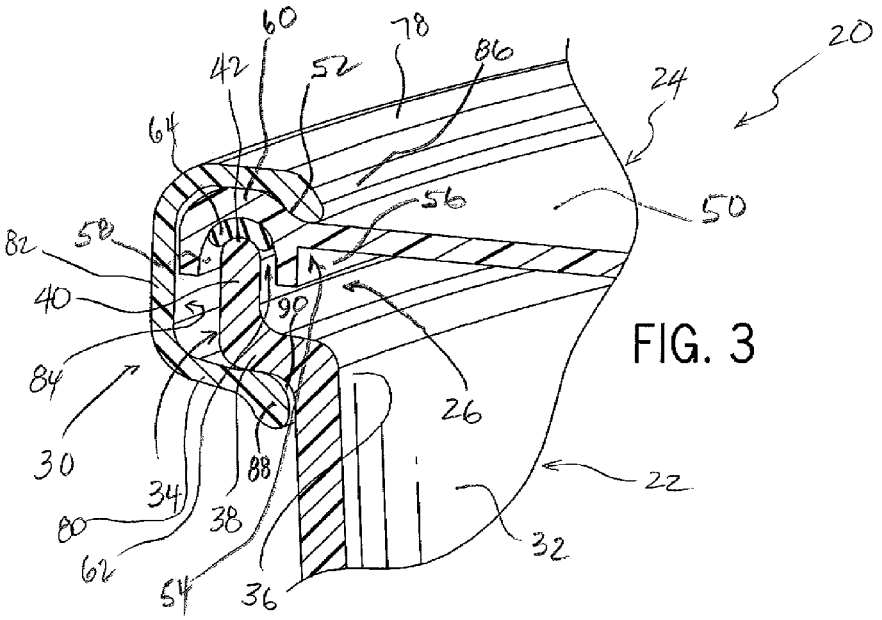
FIG. 3 shows a fragmentary cross-section taken along line 3-3 of the container assembly shown in FIG. 2.

Turning now to the drawings, FIGS. 1-3 show one example of a container assembly 20 of a type in accordance with the teachings of the present invention. The container assembly 20 has a drum-type container 22, a lid 24 closing a top opening 26 of the container, and a unitary lock ring 30 securing the lid to the drum. The lock ring 30 is constructed in accordance with the teachings of the present invention. FIG. 2 shows a top view of the container assembly 20 depicted in FIG. 1 and illustrates the unitary lock ring 30 closed or clamped around the perimeter of the lid 24 and the top opening 26 of the container 22 to secure the lid in place. FIG. 3 shows a cross-section of the lid 24 and drum 22 and the unitary lock ring 30 clamping the lid to the drum. The drum 22 in this example is a conventional plastic drum with a somewhat cylindrical side wall 32, a closed bottom (not shown), and a container rim 34 around a top 36 of the side wall surrounding the top opening 26. The container rim 34 has an annular shoulder 38 that protrudes radially outward from the top edge 36. The container rim also has an annular rim flange 40 that extends upward from the free edge of the shoulder 38 and terminates at a top edge 42.

The size and shape of the container 22 can vary within the spirit and scope of the present invention. As noted above, the material from which the container 22 is made can also vary. Instead of the container being molded as a one-piece plastic structure, as in the present example, the container can instead be formed of multiple steel components that are welded together or otherwise suitably assembled, or can be made from a fiber material with a steel bottom, a steel chime around the top opening, and a steel chime around the bottom, if desired. The disclosed unitary lock rings of the present invention can be utilized on containers other than the specific container 22 disclosed and described in this example. The shape and configuration of the container rim 34 can also vary from the example described herein and yet perform as intended. The below described lock ring 30 can be altered to accommodate different sized and shaped rim features.

The lid 24 in this example has a top panel 50 that is generally disc shaped and sized to cover the top opening 26 of the container 22. The top panel 50 has a stepped surface 52 around its perimeter that is contoured upward relative to the adjacent portion of the top panel. The stepped surface 52 is connected to an annular lid rim 54 defining the outer periphery of the lid 24. As shown in FIG. 3, the lid rim 54 has an inverted U-shaped cross section. The lid rim 54 has an annular inner flange 56 depending downward from the perimeter of the top panel 52. The lid rim 54 also has an annular outer flange 58 depending downward and spaced radially outward from the inner flange 56. In this example, the inner and outer flanges 56, 58 are connected to one another at their respective top edges by a lip 60 that bridges the space between the flanges. The outer or top side surface of the lip 60 is elevated relative to the adjacent portion of the top panel 50 and transitions from the lip to the top panel along the stepped surface 52. The lid rim, i.e., the combination of the lip 60 and the inner and outer flanges 56, 58, define an upwardly closed channel 62 under the lid rim between the inner and outer flanges. When the lid 24 is attached to the container 22 to close off the top opening 26, the top edge 42 of the container rim 34 seats in the channel 62.

In this example, an optional gasket or seal 64 is provided against the inside surface of the lip 60 in the downward facing channel 62. The seal or gasket 64 can bear against the top edge 42 of the container rim 34 and help to create a tight seal between the lid 24 and container 22 when assembled. The optional gasket or seal 64, as well as the overall shape of the top panel 50 and the lid rim 54 can also vary in configuration and construction within the spirit and scope of the present invention and yet function as intended. Similar to the container 22, the lid 24 can be fabricated as a one-piece unitary structure from plastic or can be fabricated from metal or other suitable materials, depending on the application or use intended. The material used to fabricate the optional gasket or steel 64 can also vary, but in one example can be a compressible and resilient silicone or rubber material.

Figure 4:
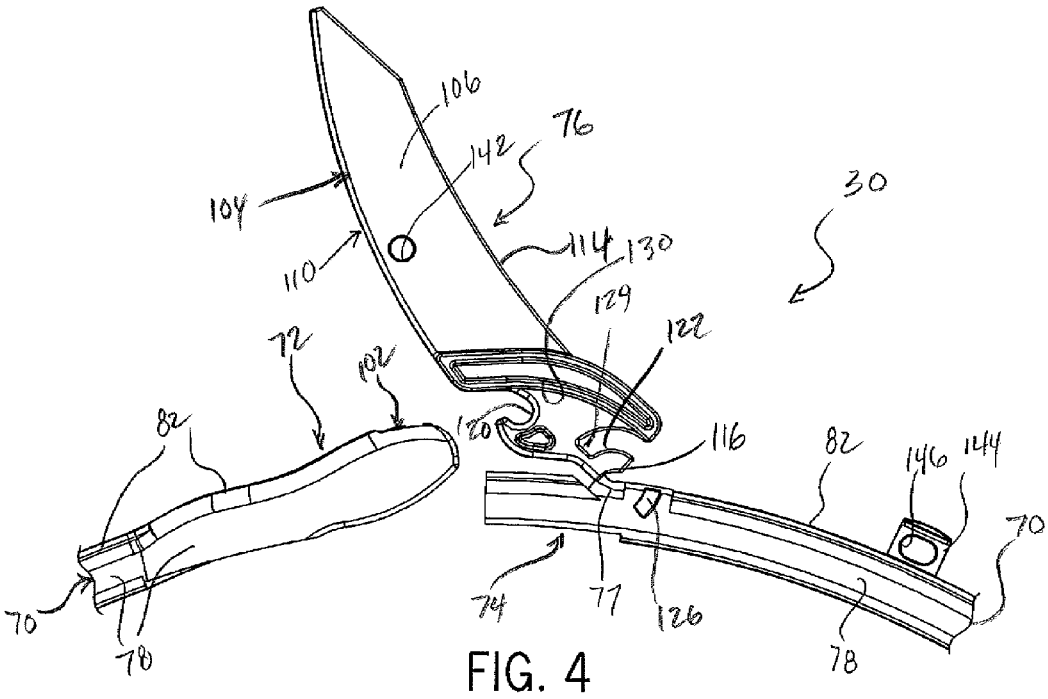
FIG. 4 shows the lever and end portions of one example of the unitary lock ring for the container assembly shown in FIG. 1 constructed in accordance with the teachings of the present invention and in an open configuration.

The lock ring 30 has a unitary, molded plastic, one-piece structure in accordance with the teachings of the present invention. The lock ring 30 requires no assembly after fabrication, is lightweight, and requires only a single mold cavity to form. Multiple components do not need to be separately formed and then assembled to one another. With reference to FIGS. 2-4, the lock ring 30 has an elongate, discontinuous, circular, or ring-shaped body 70 defining a split ring structure. In other words, the body 70 has a split that creates a first end 72 and a second end 74 that can be separated or disengaged from one another when the ring is in an opened configuration, as shown in FIG. 4. The first and second ends 72, 74 are joined to or engaged with one another when the lock ring 30 is in a closed configuration, as shown in FIGS. 1 and 2. The lock ring 30 also has a lever 76 connected by an integral living hinge 77 to the body 70 near the second end 74. The lever 76 is used to secure the first and second ends 72, 74 of the lock ring 30 to one another, as described below.

In the disclosed example, the body 70 of the unitary lock ring 30 has a somewhat C-like shape when viewed in cross section, as in FIG. 3. The body 70 has an upper portion or leg 78 that is oriented generally horizontally in this example. The body 70 also has a lower portion or leg 80 that is also oriented generally horizontally in this example. A generally vertical portion or leg 82 of the body 70 connects the upper and lower legs 78, 80 to define the C-type shape. As will be evident to those having ordinary skill in the art, the body 70 can be formed with a rounded cross-section having no readily discernable horizontal or vertical legs. Alternatively, the legs can be formed so as not to be specifically or precisely straight or linear and/or so as not to be precisely or specifically vertical or horizontal, depending on the particular needs of a given container and lid structure.

A ring channel 84 is formed by a combination of the upper leg 78, the vertical leg 82, and the lower leg 80 and faces radially inward. The ring channel 84 is sized to forcibly or interferingly receive therein and snap onto the assembled combination of the lid and container rims 54, 34. In the disclosed example, the upper leg 78 has a downturned portion 86 near its innermost edge. The downturned portion 86 is angled downward relative to horizontal or relative to a plane of the remainder of the upper leg 78. The lower leg 80 has a bead 88 adjacent its innermost edge. The bead 88 defines a rounded face 90 at the transition from the top surface and inward facing surface of the lower leg. The lower leg 80 can also be slightly angled downward in a direction toward the bead 88. The rounded face 90 and angle of the lower leg 80 can aid in attaching the lock ring 30.

When the lock ring 30 is not attached to the assembled lid 24 and container 22, a gap is defined between the downturned portion 86 and the lower leg 80 to permit entry into the channel 84. This gap is smaller than the distance between the assembled combination of the lip 60 on the lid rim 54 and shoulder 38 on the container rim 34. To install the ring body 70, the body 70 can be forced onto the assembled lid and container rims 54, 34. The gap into the channel 84 will be forcibly expanded, forcing the upper and lower legs apart. The body 70 can be zipped onto the assembled lid and container from one end to the other until the upper leg 78 snaps completely over the lip 60. As shown in FIG. 3, upper leg 78 seats over the lip 60 of the lid rim 54, when installed, and the downturned portion 86 extends over the lip 60 and engages or seats against the stepped surface 52 on the lid 24. The lower leg 80 bears against an underside of the shoulder 38 on the container rim 34 with the bead 88 seated adjacent the top 36 of the side wall 32 on the container 22.

When installed, the snap-on structure of the rims 54, 34 and legs 78, 80 will retain the lock ring 30 on the assembled lid 24 and container 22. The ring body 30 can be configured to snap over the lid lip and container shoulder in other ways while still providing a force-fit or positive engagement between the body 70 and lid and container. Thus, the configuration and construction of these components can be varied from the example herein and yet function as intended.

Figure 5:
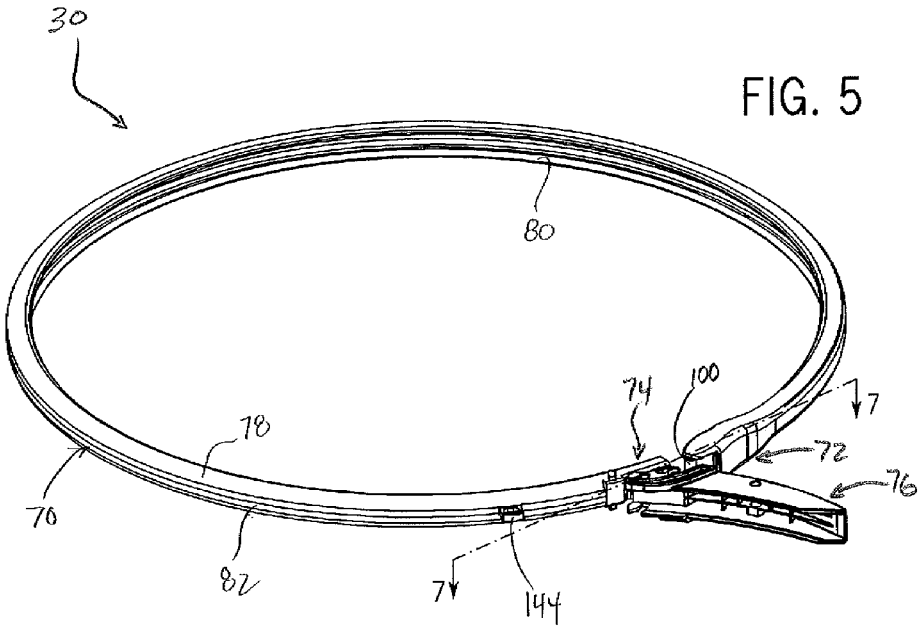
FIG. 5 shows a perspective view of the unitary lock ring shown in FIGS. 1 and 4 and in an open configuration.
Figure 6:
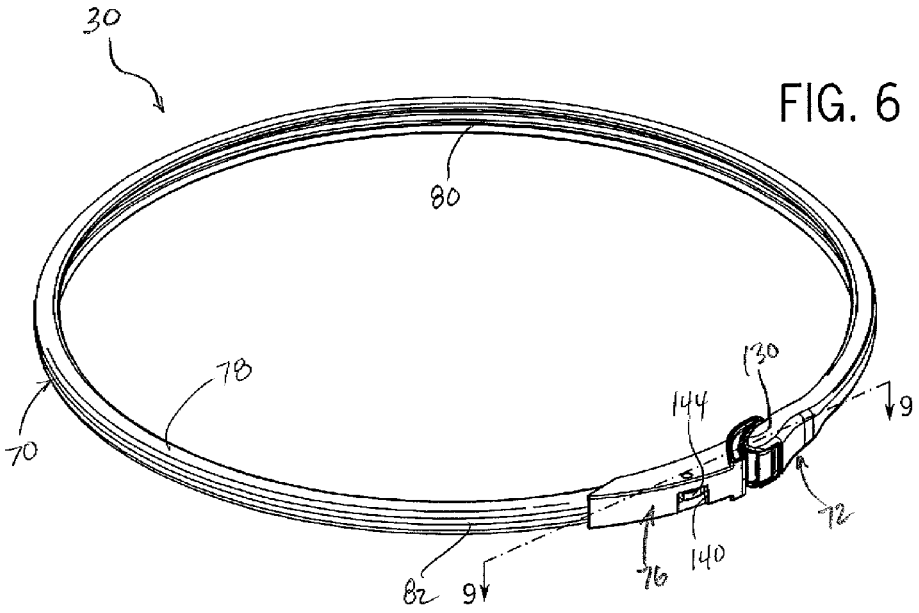
FIG. 6 shows the unitary lock ring shown in FIG. 4, but in a closed configuration.

FIG. 4 shows part of the lock ring 30, including the first and second ends 72, 74 of the body 70 and the lever 76 in the open configuration. FIG. 5 shows the entire lock ring 30, also in the open configuration with the lever 76 in the open position. In this example, the lever 76 is configured as an over-center lever integrally connected to the ring body 30 via the living hinge 77 near the second end 74 at the split. The lock ring 30 can be molded with the lever 76 in the open position as shown in FIGS. 4 and 5. The living hinge 77 might otherwise define a weak pivot joint for the lever 76, particularly when the lever is clamped down, i.e., moved to a closed position, when securing the lock ring to a container and lid. However, additional features, as described below, de-stress the living hinge 77 and relocate the pivot point of the lever 76 when clamped down or closed, as shown in FIGS. 1, 2, and 6. Because of these additional features, the living hinge 77 can withstand significant stresses or forces applied during use of the lock ring 30 with little or no difficulty. The living hinge 77 will thus perform the functions of integrally tethered the lever 76 to the body at all times, eliminating the need for assembly, and allowing the lever to freely pivot between the open and closed positions. The living hinge can thus be design with minimal suitable thickness and allow many, many lever position cycles without failing.

FIGS. 4, 5, 7, and 8A show the lever 76 in the open position and the lock ring 30 in the open configuration. Reference to these figures can be had for the following description of the lock ring ends 72, 74, and the lever 76. The first end 72 of the ring body 70 at the split has an integral molded clamping bar or pin 100 extending laterally between the upper and lower legs 78, 80. A void 102 in the vertical leg 82 is formed adjacent the pin 100 at the first end 72 providing clearance around the pin. The clamping pin 100 is thus exposed at the first end 72 of the ring body 30 but integrally formed and anchored between the body upper and lower legs 78, 80. The upper, lower, and vertical legs 78, 80, 82 of the body 70 can be formed in the region of the first end 72 to have different physical characteristics than the remainder of the body 70. The wall thickness, height, depth, spacing, and shape of the legs in this region of the body 70 can be varied, as desired. These characteristics can be designed to address any number of issues, including for reinforcing this portion of the body 70, strengthening the clamping pin 100, providing clearance for the second end 74 within the first end 72, and/or matching or mating with a configuration of the second end 74 and/or the lever 76.

The lever 76 in this example has an elongate grip section 104 that can be easily grasped by a user and provide mechanical advantage to clamp the lock ring 30 closed. The grip section 104 is also U- or C-shaped and has an upper wall 106, a lower wall 108 spaced from the upper wall, and an intermediate wall 110 connecting the upper and lower walls. The lower wall 108 can have a truncated free edge 112, different from a free edge 114 of the upper wall 106. The truncated free edge 112 can be provided to accommodate or provide clearance for the bead 88 on the lower leg 80 of the body 70 when the lever 76 is clamped or closed. The proximal end of the lever 76, and specifically the intermediate wall 110, continues integrally into the living hinge 77. The living hinge 77 in turn continues into and joins with the vertical leg 82 of the body 70. A notch 116 is formed in the body 70 across the vertical leg 82 and into the upper and lower legs 78, 80 around the living hinge 77 for mold clearance and for permitting freedom of movement of the hinge material. A pin hook 120 or engagement groove is formed across the lever 76 in the intermediate wall 110 and near the living hinge 77. As shown in FIG. 4, the pin hook 120 is on the distal side of the hinge, closer to the first end of the body 70, with the lever 76 in the open position. The pin hook 120 is configured to engage and receive the clamping pin 100 therein, as describe below.

In this example, curved guide tracks or slots 122, 124 are respectively formed in each of the upper and lower walls 106, 108 on the lever 76. The guide tracks 122, 124 open into the distal end of the lever 76 in their respective walls. The curvature of the guide tracks 122, 124 essentially follows the pivotal movement of the lever 76 between the open and closed positions. Thus, the guide tracks or slots 122, 124 are positioned and shaped to create a path at a relatively constant radial distance from the pivot point of the lever 76 created by the living hinge 77. A lug or boss 126, 128 respectively protrudes integrally from each of the upper and lower legs of the body 70. The lugs or bosses 126, 128 protrude from the outer surfaces of the legs 78, 80 away from the channel 84 and opposite one another. Each boss 126, 128 is sized and shaped to be received in and slide along its corresponding guide track 122, 124. In this example, the bosses 126, 128 have a width and a curved shape that closely correspond with the width and curvature of the guide tracks or slots 122, 124. As described below, the bosses and guide tracks alleviate the stresses on the living hinge when the lock ring 30 is clamped onto a container.

Figures 7, 8A:
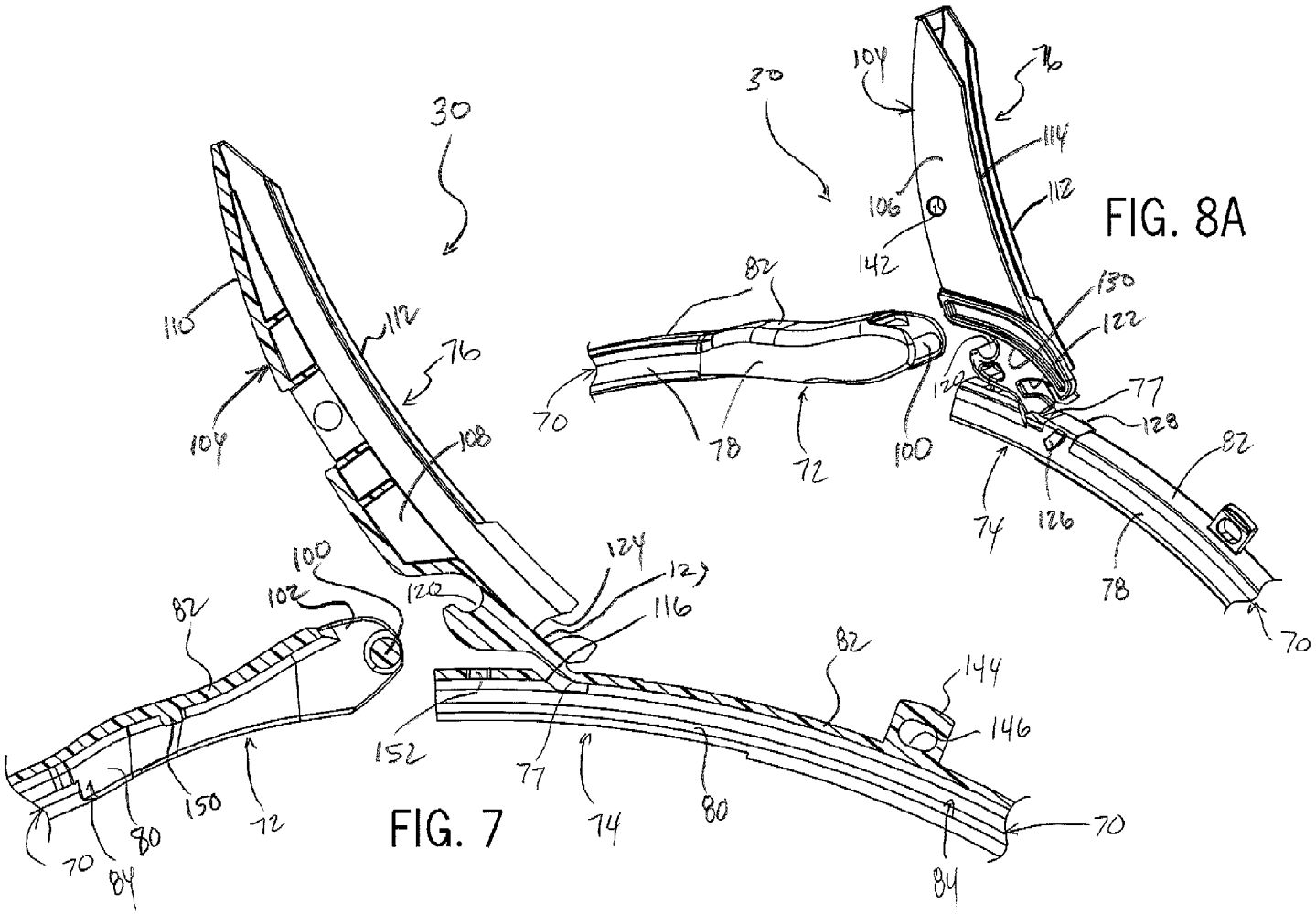
FIG. 7 shows a cross-section taken along line 6-6 of the unitary lock ring shown in FIG. 5 and in the same open configuration shown in FIG. 4.
FIGS. 8A-8F show the progression of the unitary lock ring from the open configuration shown in FIGS. 4, 5 and 7 to the closed, clamped configuration shown in FIG. 6.
Figures 8B, 8C:
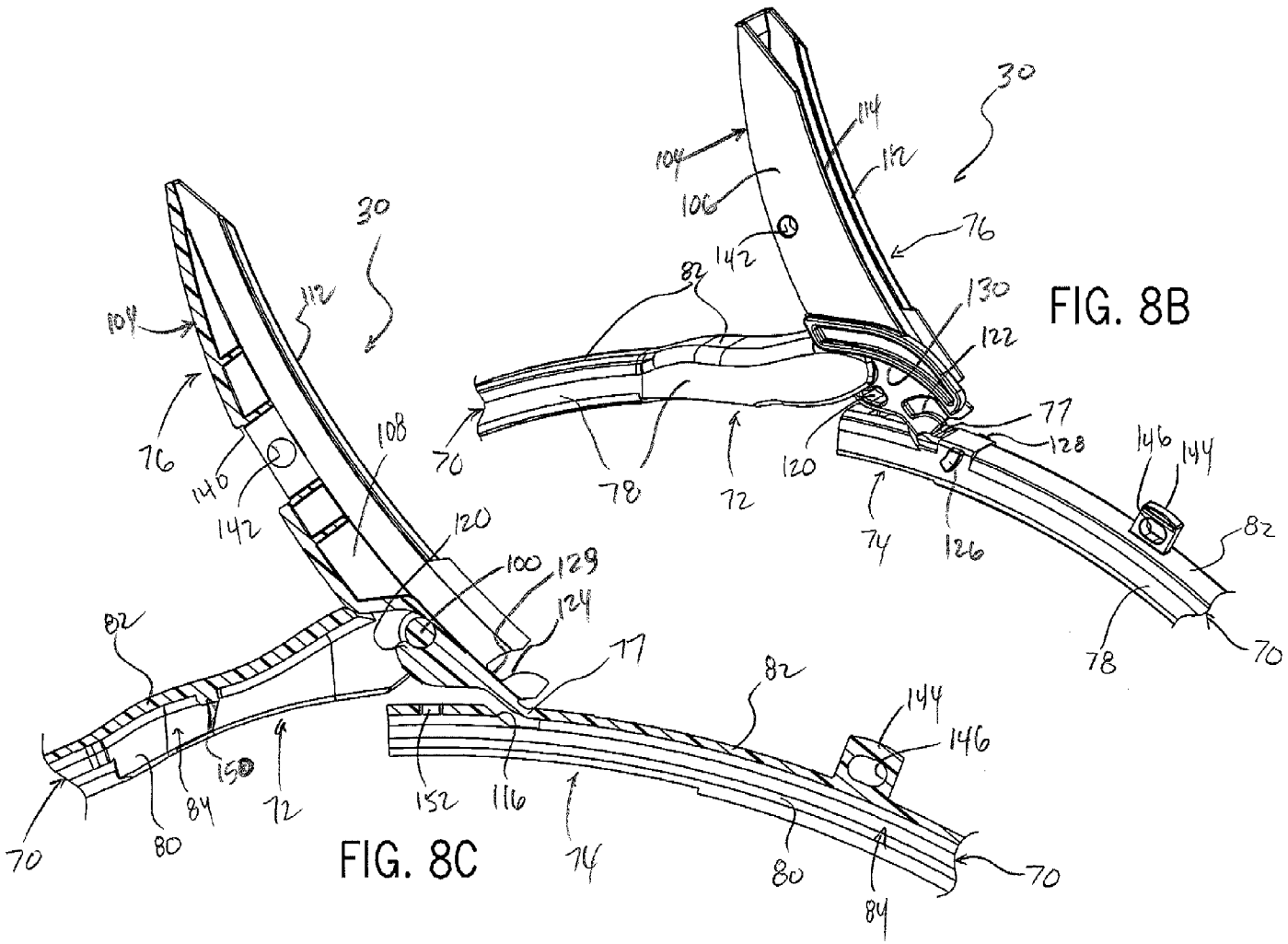
Figure 8D:
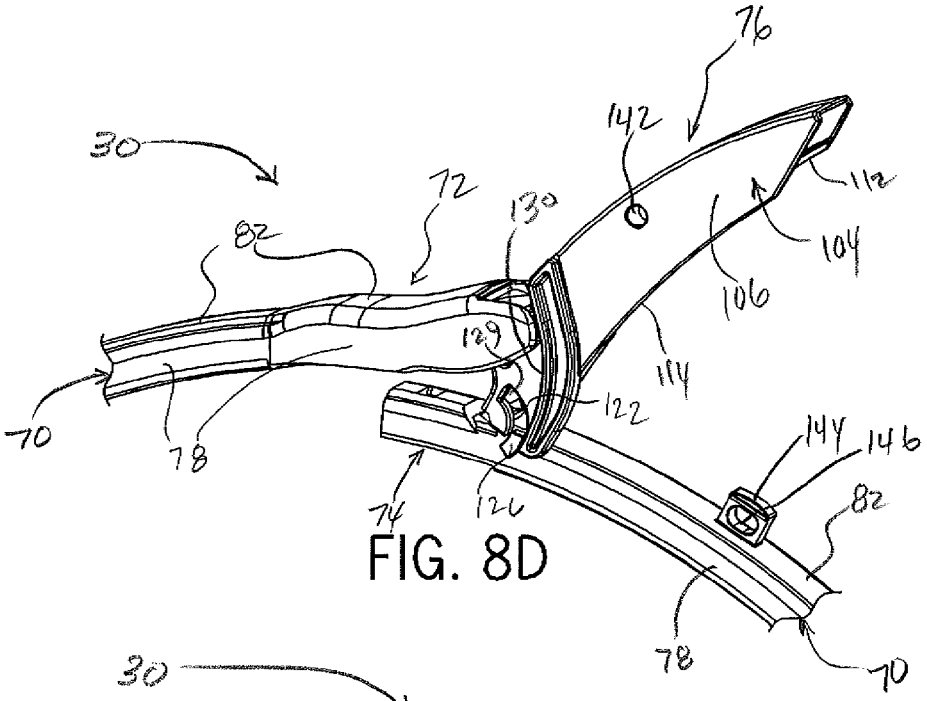
Figure 8E:
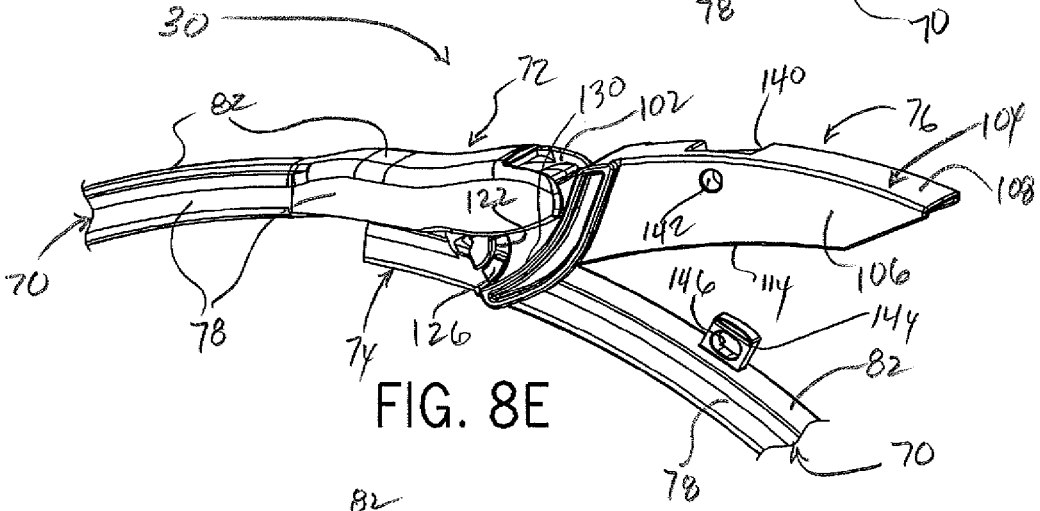
Figure 8F:
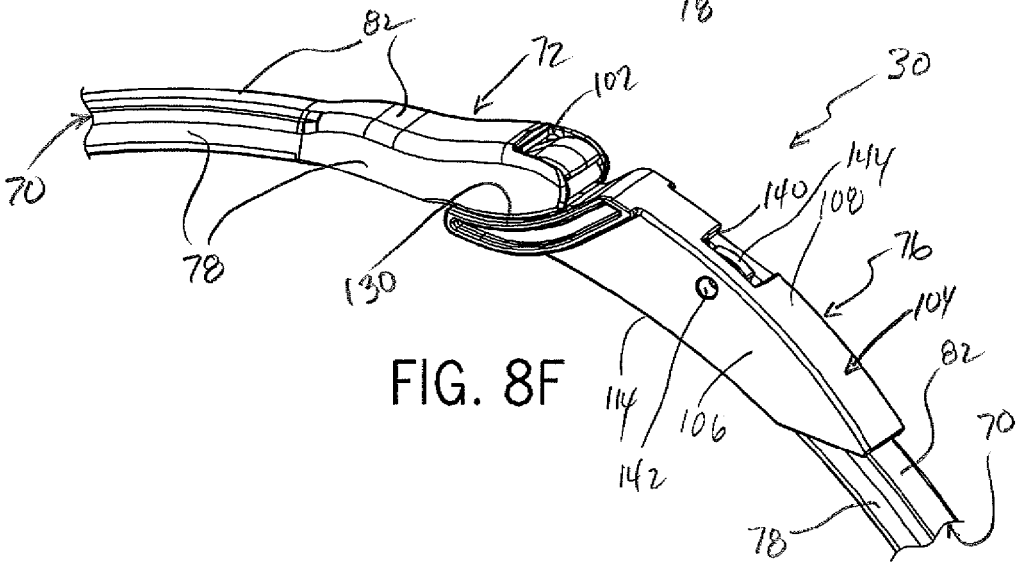
Figure 9:
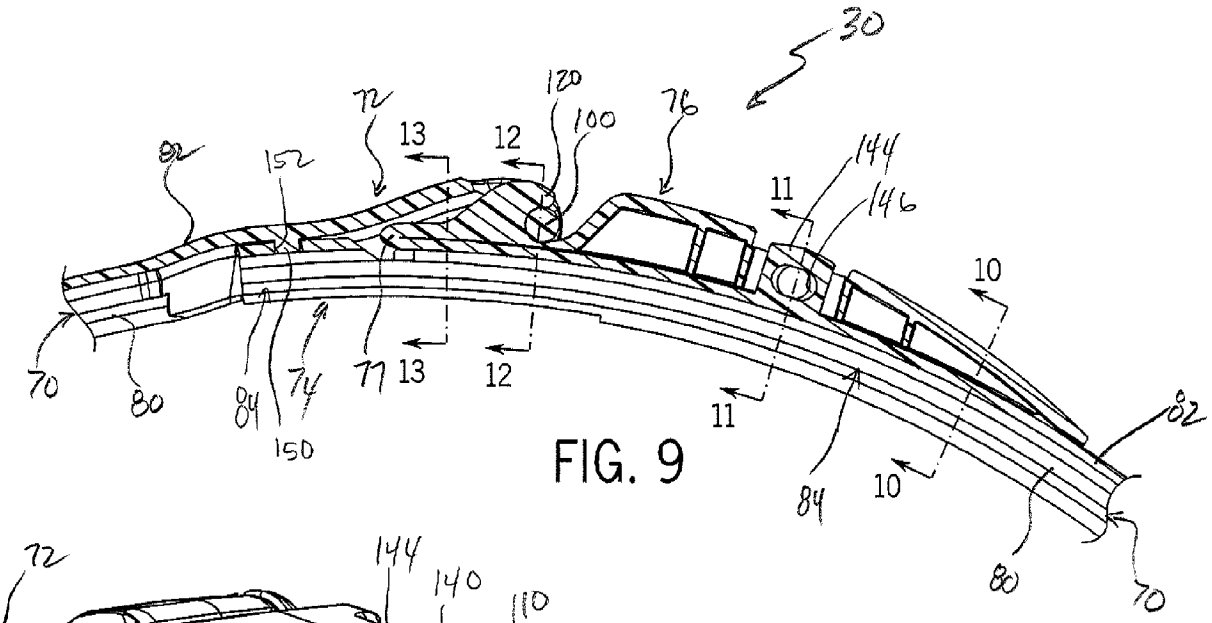
FIG. 9 shows a cross-section taken along line 9-9 of the closed unitary lock ring shown in FIG. 6.

FIGS. 8A-8F show the progression of the unitary lock ring 30 from the open configuration of FIGS. 4, 5, and 7 to the closed configuration of FIGS. 6 and 9. FIG. 8A shows the lock ring 30 in the open configuration and the lever 76 in the open position. The second end 74 of the body 70 can be moved relative to the first end 72 rather easily since the body 70 is a flexible plastic. As shown in FIG. 8A, the two ends 72, 74 can be moved in order to seat the clamping pin 100 in the pin hook 120, as shown in FIGS. 8B and 8C. Once the clamping pin 100 is engaged with the pin hook 120, the first and second ends 72, 74 of the ring body 70 are engaged with one another and are no longer separate from one another at the split in the body 70.

The diameter of the ring body 70 is sized so that it can readily fit around the circumference of the assembled lid 24 and container 22. When installed as described above and when the pin hook 120 is connected to the clamping pin 100, the user can begin to pivot the lever 76 in a direction toward the second and 74 of the body 70. This motion will begin to draw the first end 72 of the body 30 toward the second end 74, as shown in FIG. 8D. As the lever 76 is moved in this direction, tension may begin to be perceived in the ring body 70 as the diameter is reduced to more snuggly fit the container and lid diameter. Also, the lever 76 may initially begin to pivot about the living hinge 77. However, the bosses 126, 128 will then be aligned with and received in the open ends of the corresponding guide tracks 122, 124, also as shown in FIG. 8D. Prior to this point, some of the tension in the ring body 70 might have begun to be exerted on the living hinge 77. However, once the bosses 126, 128 seat in the guide tracks 122, 124, the fixed bosses 126, 128 and the material of the lever walls 106, 108 surrounding the guide tracks 1.2, 124 will be subjected to the loading or tension in the ring body 70, not the living hinge 77. As tension in the body 70 increases, the clamping pin will pull in the direction of the first end 72. The bosses 126, 128 and not the living hinge will provide the reactive force in the opposite direction.

The lever 76 will then continue pivoting downward toward the second end 74 of the body 70 has depicted in FIG. 8E. As the lever is pivoted, the pin hook travels from one side of the living hinge to the other side, or "over center" relative to the pivot point of the lever. The pin hook of the lever continues to pull the clamping pin 100, and thus the first end 72 further toward the second end 74 to close the lock ring 30. The bosses 126, 128 continue to ride along the guide tracks 122, 124 and thus will guide the lever 76 along a specific path determined by the shape of the tracks as the lever is moved to the closed position as shown in FIGS. 8F and 9. Loads or forces exerted by the lever pulling together the ends 72, 74 of the ring body 30 are redirected or redistributed from the living hinge to the bosses and material surrounding the guide tracks, relieving stress on the living hinge. In the fully closed position, the bosses 126, 128 can seat in and bear against the terminal closed ends 129 of the guide tracks 122, 124. This provides a very strong lock ring 30 when clamped or closed.

At least one or both of the upper or lower walls, in this case the upper wall 106, of the lever 76 can have a curved contact or bearing rib 130. The rib 130 can be positioned near but spaced from the forward or proximal edge of the wall and can be located and configured to nest or seat against a surface of the one end 72 on the ring body 70. The inner surfaces of the upper and lower legs 78, 80 on the first end 72 can bear against the outer surfaces of the lever upper and lower walls 106, 108 adjacent the rib or ribs 130. The rib or ribs 130 can also be provided to add structural rigidity and integrity to the lever 76. Also, the spacing between the upper and lower legs 78, 80 at the first end 72 can be such that the second end 74 nests or seats between the legs in the first end. The other of the upper or lower walls 106, 108 on the lever 76 can also include such a rib 130, or at least a partial rib. The ribs can be configured to help position and guide the two ends 72, 74 of the body 70 together when the lock ring 30 is clamped or closed and to positionally fix the two ends relative to one another once closed or clamped. Also, the upper and lower legs 78, 80 on the first end are spaced such that they cover the bosses 126, 128 and guide tracks 122, 124 as shown in FIGS. 8E and 8F.

As shown in FIGS. 8E, 8F, and 9, a lock opening 140 can be provided through the intermediate wall 110 on the lever 76. A lock hole 142 can also be provided through one or both of the upper and lower walls 106, 108, depending on whether the lock opening 140 continues into one of the walls, as it does in this example into the lower wall 108. The body 70 can have lock tab 144 that projects upward from the vertical leg 82 and into the lock opening when the lever is closed. The lock tab 144 can have a tab hole that aligns with the lock hole 142 when closed. The unitary lock ring 30 can be locked in the secured or clamped configuration onto a container by placing a lock of some type through the aligned tab hole and lock hole. This will lock the lever 76 in the closed position and prevent it from being moved until the lock is removed.

Figure 10:
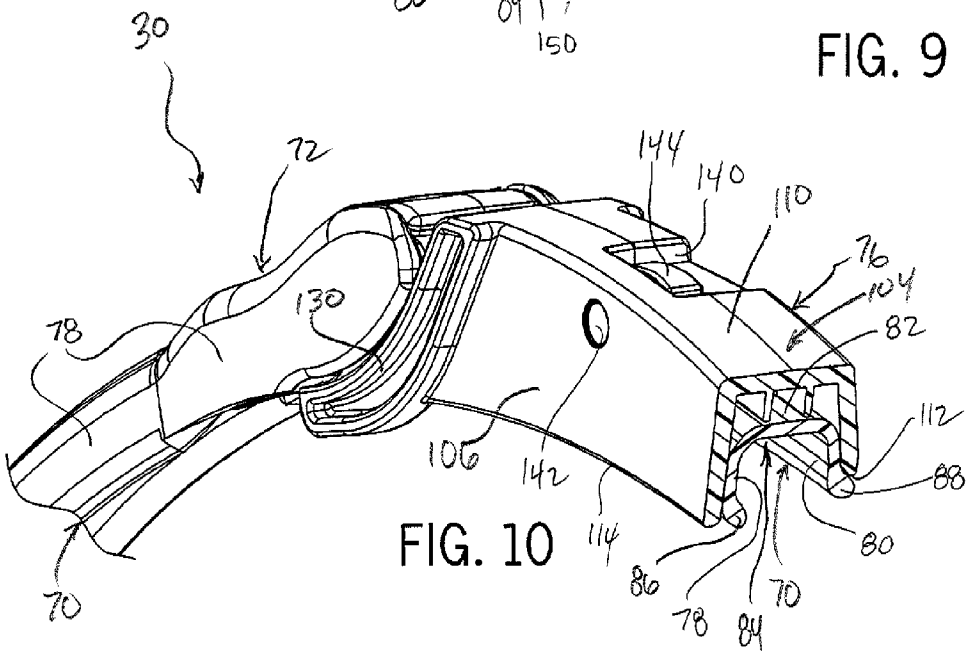
FIG. 10 shows a perspective cross-section taken along line 10-10 of the closed unitary lock ring shown in FIG. 9.
Figure 11:
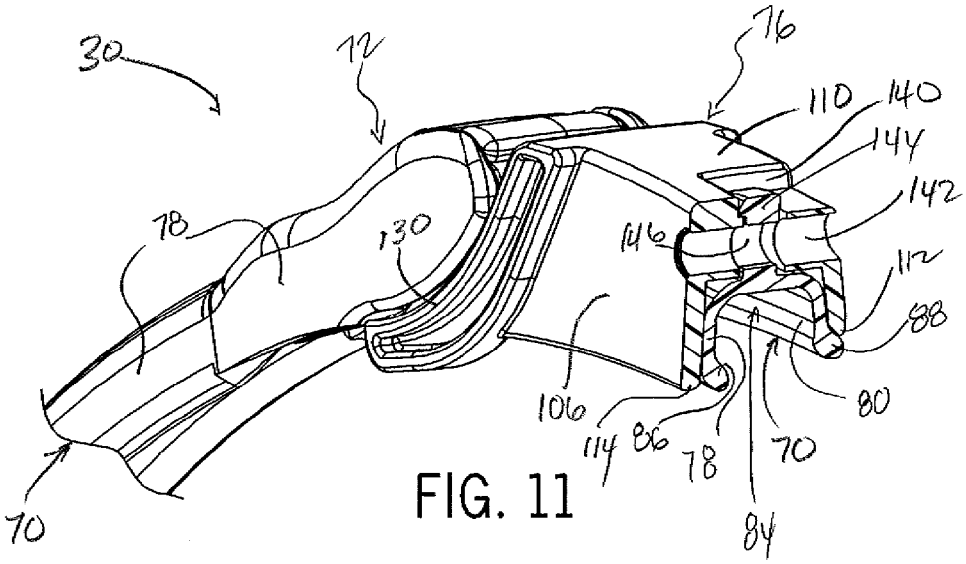
FIG. 11 shows a perspective cross-section taken along line 11-11 of the closed unitary lock ring shown in FIG. 9.
Figure 12:
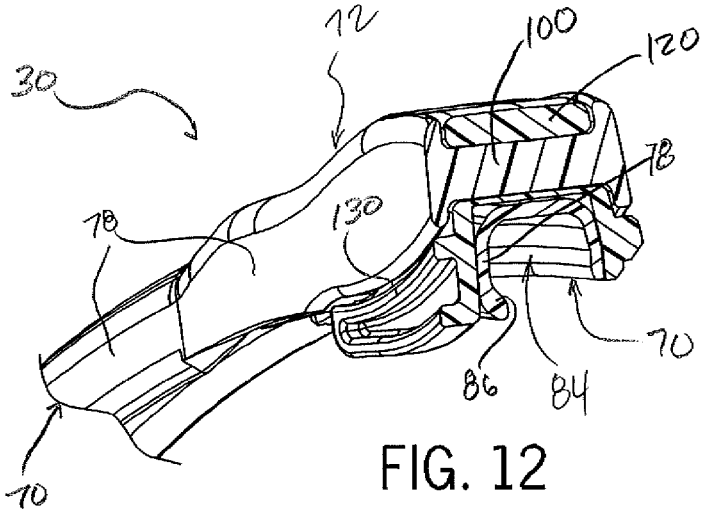
FIG. 12 shows a perspective cross-section taken along line 12-12 of the closed unitary lock ring shown in FIG. 9.
Figure 13:
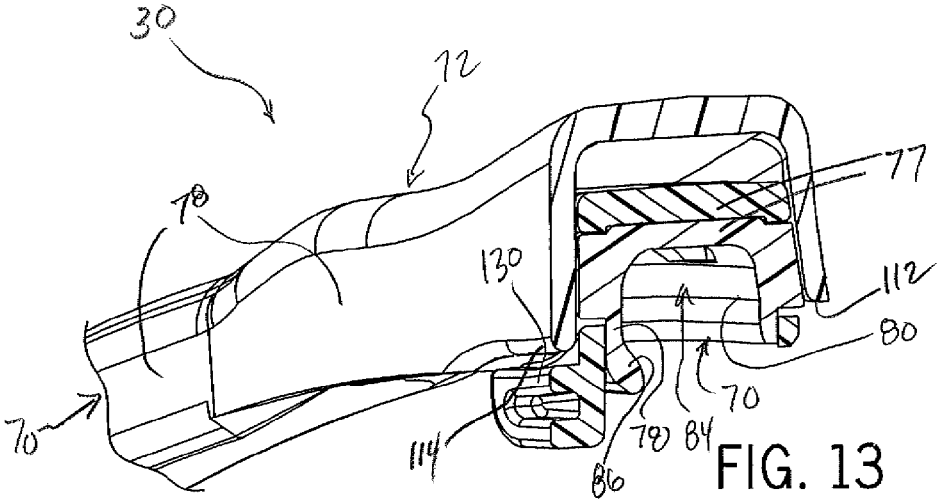
FIG. 13 shows a perspective cross-section taken along line 13-13 of the closed unitary lock ring shown in FIG. 9.

FIGS. 10-13 show various cross-sections through the lever 76 and ring body 70 in the closed position and configuration of FIG. 9. FIG. 10 shows a cross-section of the lever 76 nested over the body 70 near the second and 72. FIG. 11 shows a cross-section of the aligned lock tab 144, tab hole, 146, and lock hole 142 of the lever 76 in the closed position. As can be seen, the material on the interior of the levers 76 can be thicker in the region of the lock components in order to provide a sturdier and more secure lever lock, if desired. In an alternative embodiment, several ribs or other structures can be provided on and protruding from each of the body 30 and lever 76 surfaces so that the structures nest with one another to define a plurality of aligned holes through which a portion of the lock can pass. FIG. 12 shows a cross-section through the clamping pin 110 and the pin hook 120 also in the closed position. FIG. 13 shows a cross-section of the lever 76 and the body 70 near the living hinge 77.

With reference to FIGS. 7, 8C, and 9, the lock ring 30 can be provided with other features to assist in strengthening the ring when closed or clamped. In one example, additional protrusions and corresponding recesses can be provided in the various mating components in order to further relieve stress in the clamping pin 100 and the bosses 126, 128 when under tension and distribute the loads or forces to these additional protrusions and recesses. A protrusion 150 is depicted on the interior of the channel 84 in the body 70 spaced from the first and. A corresponding recess 152 is provided near the second end 74 on the vertical leg 82. With the lock ring 30 in the closed configuration and the lever 76 in the closed position, the protrusion 150 seats in the recess 152, adding additional tensile strength to the lock ring 30.

As will be evident to those having ordinary skill in the art upon reading this disclosure, the specific configuration and construction of the unitary lock ring 30 disclosed and described herein can vary from the example shown. Positional relationships, sizes, shapes, surface contours, and the like can vary and yet function as intended. Features of the unitary lock ring 30 can also be added or removed, as well as altered, without departing from the spirit and scope of the present invention. In addition, the material used to form the unitary lock ring disclosed and described herein can vary considerably as well. However, the material should be suitable to allow for formation of a living hinge sufficient to permit the lever to move relative to the ring body between the open and closed configurations.

The bosses can be provided on the lever and the guide tracks can be provided on the second end of the body, if desired. Similarly, the first end of the body can be configured to nest with the second end in the closed configuration of the ring. The guide tracks may include only a single track and the bosses may include only a single boss. More than two of each could also be provided. The secondary lock tab feature can also include two or more tabs for receiving two or more locks, if desired.

The one-piece unitary structure made of plastic is highly advantageous and a significant improvement over existing metal and plastic lock rings of this type. The cost is significantly reduced. The size and weight is also less than conventional rings of this type. The amount of bulk resin material usage is also reduced. The disclosed lock ring can be exceptionally strong and yet be made having relatively thin wall thickness in much of the ring. The multiple load bearing elements of the structure can distribute forces exerted upon the lock ring to multiple points along the ring and the joint at the split. The complexity of the mold cavity requirements is also reduced because only a single cavity is required to make the entire lock ring component.

Although certain lock rings for drum lids and features for such lock rings have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A lock ring for securing a lid to a container, the lock ring comprising:

a ring shaped body having a first free end and a second free end;

a clamping pin exposed near and carried by the first free end; and a lever connected to the body via a living hinge near the second free end, the lever having a hook thereon configured to engage the clamping pin, the lever pivotable between a closed position and an open position, wherein the hook is configured to selectively engage the clamping pin and draw the first and second free ends closely adjacent one another with the lever moved to the closed position and wherein the hook is capable of disengaging the clamping pin when the lever is in the open position, and wherein the body, lever, and clamping pin are integrally formed of a one-piece unitary structure, and wherein the lever pivots back onto the second end of the body in the closed position.

2. The lock ring according to claim 1, wherein the body, lever, and clamping pin are formed of the same material.

3. The lock ring according to claim 1, wherein the body is generally C-shaped in cross-section with an upper leg, a lower leg, a vertical leg connecting the upper and lower legs, and a radially inward facing channel defined within the upper, lower, and vertical legs.

4. The lock ring according to claim 3, wherein the upper leg has a downturned portion at an innermost edge thereof.

5. A lock ring for securing a lid to a container, the lock ring comprising:

a ring shaped body having a first free end and a second free end;

a clamping pin exposed near the first free end; and a lever connected near the second free end and having a hook thereon configured to engage the clamping pin, the lever pivotable between a closed position and an open position, wherein the hook is configured to selectively engage the clamping pin and draw the first and second free ends closely adjacent one another with the lever moved to the closed position and wherein the hook is capable of disengaging the clamping pin when the lever is in the open position, wherein the body, lever, and clamping pin are integrally formed of a one-piece unitary structure and the lever is connected via a living hinge to the body, wherein the body is generally C-shaped in cross-section with an upper leg, a lower leg, a vertical leg connecting the upper and lower legs, and a radially inward facing channel defined within the upper, lower, and vertical legs, and wherein the lower leg has a bead formed on an innermost edge thereof, the bead having a rounded face thereon facing radially inward.

6. The lock ring according to claim 1, wherein the second end of the body is sized to fit within the first end of the body when the lock ring is in a closed configuration and the lever is in the closed position.

7. The lock ring according to claim 1, wherein the living hinge is positioned adjacent a notch formed in the vertical leg of the body near the second end.

8. The lock ring according to claim 1, further comprising:

a lock tab protruding from a portion of the body and having a tab hole formed therethrough;

a lock opening formed in the lever; and a lock hole formed through the lever, wherein the lock tab is positioned within the lock opening in the lever and the lock hole aligns with the tab hole when the lever is in the closed position.

9. The lock ring according to claim 1, wherein the lock ring is formed of a molded plastic material.

10. A lock ring for securing a lid to a container, the lock ring comprising:

a ring shaped body having a first free end and a second free end;

a clamping pin exposed near the first free end; and a lever connected near the second free end and having a hook thereon configured to engage the clamping pin, the lever pivotable between a closed position and an open position, wherein the hook is configured to selectively engage the clamping pin and draw the first and second free ends closely adjacent one another with the lever moved to the closed position and wherein the hook is capable of disengaging the clamping pin when the lever is in the open position, wherein the body, lever, and clamping pin are integrally formed of a one-piece unitary structure and the lever is connected via a living hinge to the body, and wherein the lever nests over the second end of the body in the closed position and wherein the second end of the body nests within the first end of the body with the lock ring in a closed configuration.

11. A lock ring for securing a lid to a container, the lock ring comprising:

a ring shaped body having a first free end and a second free end;

a clamping pin exposed near the first free end;

a lever connected near the second free end and having a hook thereon configured to engage the clamping pin, the lever pivotable between a closed position and an open position, wherein the body, lever, and clamping pin are integrally formed of a one-piece unitary structure and the lever is connected via a living hinge to the body;

one or more bosses protruding from a part of the lock ring near the living hinge; and one or more guide tracks formed in another part of the lock ring near the living hinge, wherein the hook is configured to selectively engage the clamping pin and draw the first and second free ends closely adjacent one another with the lever moved to the closed position and wherein the hook is capable of disengaging the clamping pin when the lever is in the open position, and wherein each of the one or more bosses slides along a corresponding track of the one or more guide tracks when the lever is moved between the open and closed positions.

12. The lock ring according to claim 11, further comprising:

two of the bosses, one each on a side of the body near the second end; and two of the guide tracks, one each on opposed sides of the lever.

13. The lock ring according to claim 11, wherein each of the one or more guide tracks is curved.

14. The lock ring according to claim 11, wherein the one or more bosses and guide tracks are covered and hidden by a portion of the lock ring with the lever in the closed position and the lock ring in a closed configuration.

15. The lock ring according to claim 14, wherein portions of the first end of the body move onto and cover the one or more bosses and guide tracks.

16. A lock ring for securing a lid to a container, the lock ring comprising:

a ring shaped body having a first free end and a second free end;

a clamping pin exposed near the first free end;

a lever connected near the second free end and having a hook thereon configured to engage the clamping pin, the lever pivotable between a closed position and an open position, wherein the body, lever, and clamping pin are integrally formed of a one-piece unitary structure and the lever is connected via a living hinge to the body; and one or more bosses and one or more guide slots that engage one another to de-stress or unload the living hinge when the lever is moved between the open and closed positions, wherein the hook is configured to selectively engage the clamping pin and draw the first and second free ends closely adjacent one another with the lever moved to the closed position and wherein the hook is capable of disengaging the clamping pin when the lever is in the open position.

17. The lock ring according to claim 16, wherein portions of the first end of the body move onto and cover the one or more bosses and guide tracks with the lever in the closed position.

18. A lock ring for securing a lid to a container, the lock ring reconfigurable between a locked and an unlocked configuration and comprising:

a ring shaped body having a first end, a second end, and a split therebetween;

a clamping pin exposed near the first end;

a lever connected near the second end and having a hook thereon configured to engage the clamping pin, the lever pivotable between a closed position and an open position, the hook configured to selectively engage the clamping pin and draw the first and second ends closely adjacent one another with the lever moved to the closed position and capable of disengaging the clamping pin the lever in the open position;

a guide track on one of the body and the lever; and a boss on the other of the body and the lever and configured to seat in and move along the guide track as the lever is moved toward the closed position, wherein the body, lever, clamping pin, guide track and boss are integrally formed as a one-piece unitary structure and the lever is connected via a living hinge to the body, and wherein the boss and guide track are arranged to redefine the lever pivot from the living hinge with the boss engaged with the guide track.

19. The lock ring according to claim 18, further comprising:

a lock tab protruding from a portion of the body and having a tab hole formed therethrough;

a lock opening formed in the lever; and a lock hole formed through the lever, wherein the lock tab is positioned in the lock opening in the lever and the lock hole aligns with the tab hole with the lever in the closed position.

20. The lock ring according to claim 18, wherein portions of the first end of the body move onto and cover and hide the one or more bosses and guide tracks with the lever in the closed position.

* * * * *